US011918100B2

(12) United States Patent
Litterick et al.

(10) Patent No.: US 11,918,100 B2
(45) Date of Patent: Mar. 5, 2024

(54) BEAD

(71) Applicant: HAIR CHARMS BY KELA PTY LTD, Langford (AU)

(72) Inventors: Kelly Anne Litterick, Langford (AU); Edward Joseph Khoury, Bateman (AU)

( * ) Notice: Subject to any disclaimer, the term of this patent is extended or adjusted under 35 U.S.C. 154(b) by 675 days.

(21) Appl. No.: 16/305,813

(22) PCT Filed: May 26, 2017

(86) PCT No.: PCT/AU2017/050495
§ 371 (c)(1),
(2) Date: Nov. 29, 2018

(87) PCT Pub. No.: WO2017/205904
PCT Pub. Date: Dec. 7, 2017

(65) Prior Publication Data

US 2021/0219691 A1 Jul. 22, 2021

(30) Foreign Application Priority Data

May 31, 2016 (AU) ..... 2016902069
Aug. 3, 2016 (AU) ..... 2016903052

(51) Int. Cl.
*A45D 8/00* (2006.01)

(52) U.S. Cl.
CPC ..... *A45D 8/008* (2021.01)

(58) Field of Classification Search
CPC ..... A45D 8/008; A45D 8/004; A45D 8/24; A45D 8/36; A45D 8/34
See application file for complete search history.

(56) References Cited

U.S. PATENT DOCUMENTS 2,130,748 A * 9/1938 Suter ..... A45D 4/06 132/211
3,662,767 A * 5/1972 Murtha ..... A45D 7/04 132/212
4,554,934 A * 11/1985 Mooneyhan ..... A45D 8/24 132/245
5,934,293 A * 8/1999 Kaizuka ..... A45D 2/40 132/224

(Continued)

FOREIGN PATENT DOCUMENTS

FR 2481897 * 11/1981

*Primary Examiner* — Rachel R Steitz
*Assistant Examiner* — Brianne E Kalach
(74) *Attorney, Agent, or Firm* — GUGLIOTTA & GUGLIOTTA LPA

(57) ABSTRACT

A bead (10) comprising first and second members (12, 14) pivotally secured adjacent first sides (16) thereof such that the first and second members (12, 14) are pivotable between a closed position and an open position. First and second openings (28) are defined between the first and second side members (12, 14) when in the closed position. A first resilient pad (33) is provided on the first side surface of the first member (12) and a second resilient pad (35) on the first side surface of the second member (14). The first and second resilient pads (33. 35) include complementary ridges (42) on adjacent inner surfaces (40) such that when the first and second members (12, 14) are in the closed position, the ridges (42) engage to deflect the hair (11) passing through the bead (10) from the first opening (28) to the second opening (28).

15 Claims, 9 Drawing Sheets

(56) References Cited

U.S. PATENT DOCUMENTS

| | | | | | |
|---|---|---|---|---|---|
| 6,016,813 | A * | 1/2000 | Kennedy | A45D 8/34 | 132/200 |
| 6,089,240 | A * | 7/2000 | Chang | A45D 8/34 | 132/273 |
| 6,142,158 | A * | 11/2000 | Lloyd | A45D 8/24 | 132/278 |
| 6,311,699 | B1 * | 11/2001 | Horman | A45D 8/34 | 132/273 |
| D463,621 | S * | 9/2002 | Tobin | D28/41 | |
| 6,631,538 | B1 * | 10/2003 | Carr | A41F 19/00 | 24/3.13 |
| 6,691,717 | B2 * | 2/2004 | Silva | A45D 8/36 | 132/277 |
| 8,307,835 | B2 * | 11/2012 | King | A45D 8/24 | 132/277 |
| 8,783,269 | B1 * | 7/2014 | Deer | A45D 2/02 | 132/273 |
| 10,575,615 | B2 * | 3/2020 | Johnson | A45D 2/42 | |
| 2007/0144551 | A1 * | 6/2007 | Redmond | A45D 8/34 | 132/275 |
| 2008/0000492 | A1 * | 1/2008 | Mills | A45D 19/012 | 132/212 |
| 2013/0186424 | A1 * | 7/2013 | Zachery | A45D 8/34 | 132/275 |
| 2014/0311520 | A1 * | 10/2014 | McConnell-Gill | A45D 8/008 | 132/275 |

* cited by examiner

BEAD

FIELD OF THE INVENTION

The present invention relates to a bead to be secured to hair.

BACKGROUND TO THE INVENTION

It is known for people to secure beads to their hair in order to enhance their appearance. A common method of securing such beads to hair is to simply thread a number of strands of hair through a central hole provided with the bead. While such a method produces reasonable results, the process of individually threading sections of hair through the beads and then securing the beads in place can be a time consuming exercise.

The present invention relates to a bead to be secured to the hair. The bead of the present invention is constructed to allow easy connection to provide a firm grip on the hair so that the bead remains in place.

SUMMARY OF THE INVENTION

According to one aspect of the present invention there is provided a bead comprising:

first member and second members pivotally secured adjacent first sides thereof such that the first and second members are pivotable between a closed position, in which a second side of the first member is located adjacent a second side of the second member, and an open position in which the second sides of the first and second members have moved away from each other;

a first and second openings defined between the first and second side members when in the closed position;

a first resilient pad provided on a first surface of the first member; and a second resilient pad provided on an adjacent first surface of the second member;

wherein the first and second resilient pads include complementary ridges on adjacent inner surfaces such that when the first and second members are in the closed position, the ridges engage to deflect the hair passing through the bead from the first opening to the second opening.

Preferably the ridges extend from adjacent the first side of the first and second members to adjacent the second side of the first and second members.

Preferably the ridges are arcuate in transverse cross section such that the inner surface of each of the first and second resilient pads comprises corrugations extending transversely to an axis passing centrally through the first and second openings.

In a preferred embodiment, the first member comprises a hemispherical first shell and the second member comprises a hemispherical second shell such that the first surfaces of the first and second shells are concave in shape and opposed second surfaces are convex in shape.

Preferably each of the first and second resilient pads includes an outer surface which is convex in shape to be received into the concave first surface of the first or second shell.

Preferably the first and second resilient pads are secured to the first surfaces of the first and second shells by pegs extending outwardly from the first surfaces to be received in corresponding holes in the outer surfaces of the first and second resilient pads.

In a preferred embodiment, the first and second resilient pads are constructed of a silicone material.

Preferably end surfaces of the first and second resilient pads are each concave prior to engagement together such that as the first and second resilient pads are pressed together, the upper and lower end surfaces bulge outwardly, due to the resilient nature of the material, to become generally planar.

Preferably each of the first and second shells includes recessed portions adjacent opposed ends thereof such that the recessed portions define circular first and second openings when the bead is in the closed position.

In a preferred embodiment, the bead includes a latch mechanism such that the latch mechanism holds the first and second members in the closed position.

Preferably the latch member comprises an elongate member having a first end received in a first slot provided on an inner surface of the first shell adjacent the second side and a protruding second end receivable in a second slot provided on an inner surface of the second shell.

In one embodiment, the second end of the latch member includes a protruding portion on an outer side thereof provided to resiliently engage in a corresponding notch provided in the second slot when the bead is moved to the closed position.

Preferably the pivotal connection between the first sides is provided by a hinge mechanism comprising one or more first barrels provided on the first member adjacent the first side thereof and one or more second barrels provided on the second member adjacent the first side 16 thereof, the first and second barrels including alignable apertures to receive a pin.

In one embodiment, the bead includes a connector on an outer surface thereof to which the end of a cord may be secured such that the cord can extend between a pair of beads.

Preferably the connector comprises a loop extending outwardly from the second surface of the first shell.

BRIEF DESCRIPTION OF THE DRAWINGS

The invention will now be described, by way of example, with reference to the following drawings, in which.

DETAILED DESCRIPTION OF PREFERRED EMBODIMENTS

Figure 1B:
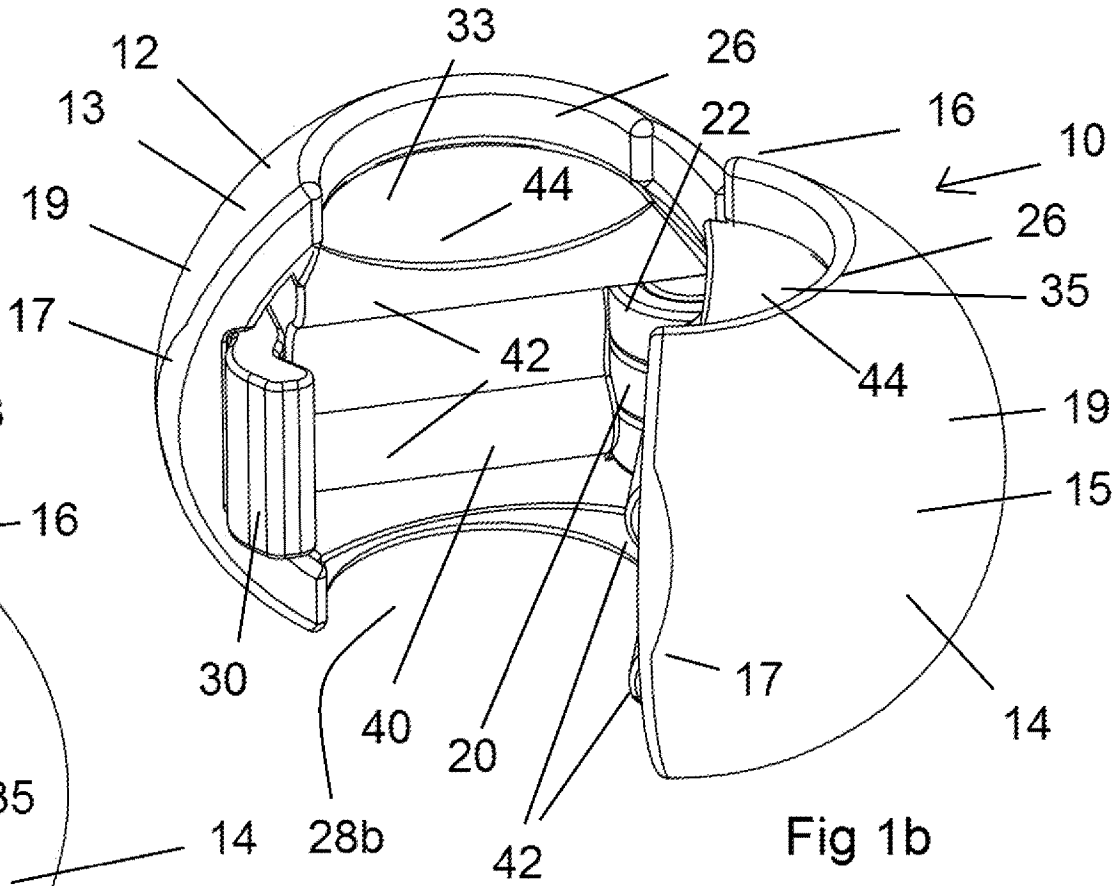
FIG. 1*b* is an upper perspective view of the bead of FIG. 1*a* in an open position.
Figure 1A:
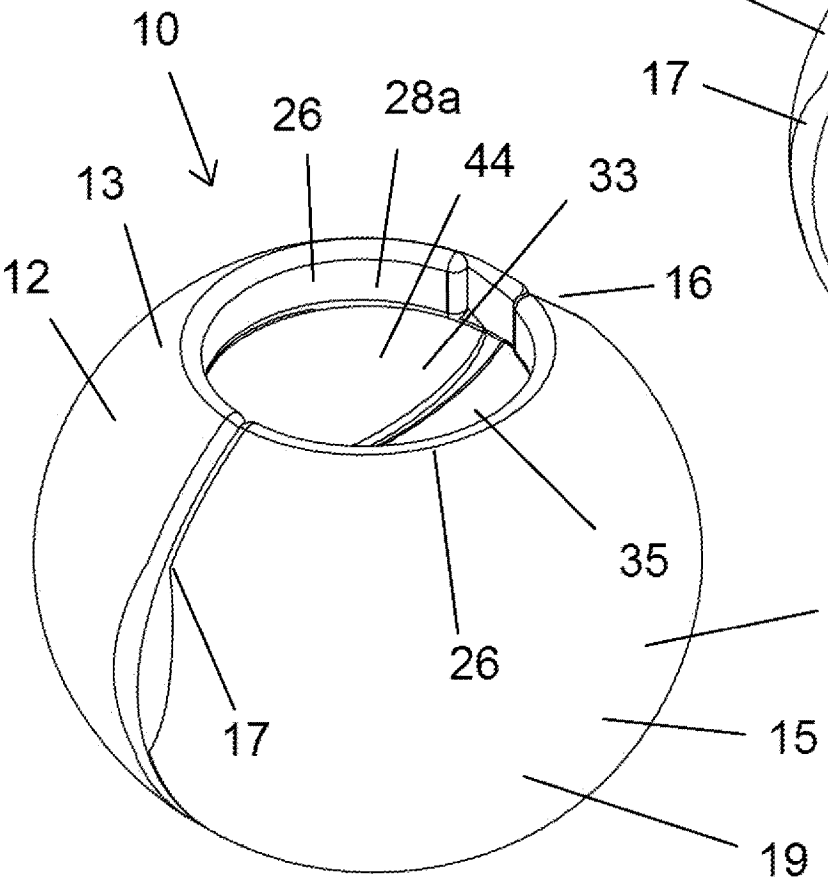
FIG. 1*a* is an upper perspective view of a bead in accordance with the present invention in a closed position.
Figure 2:
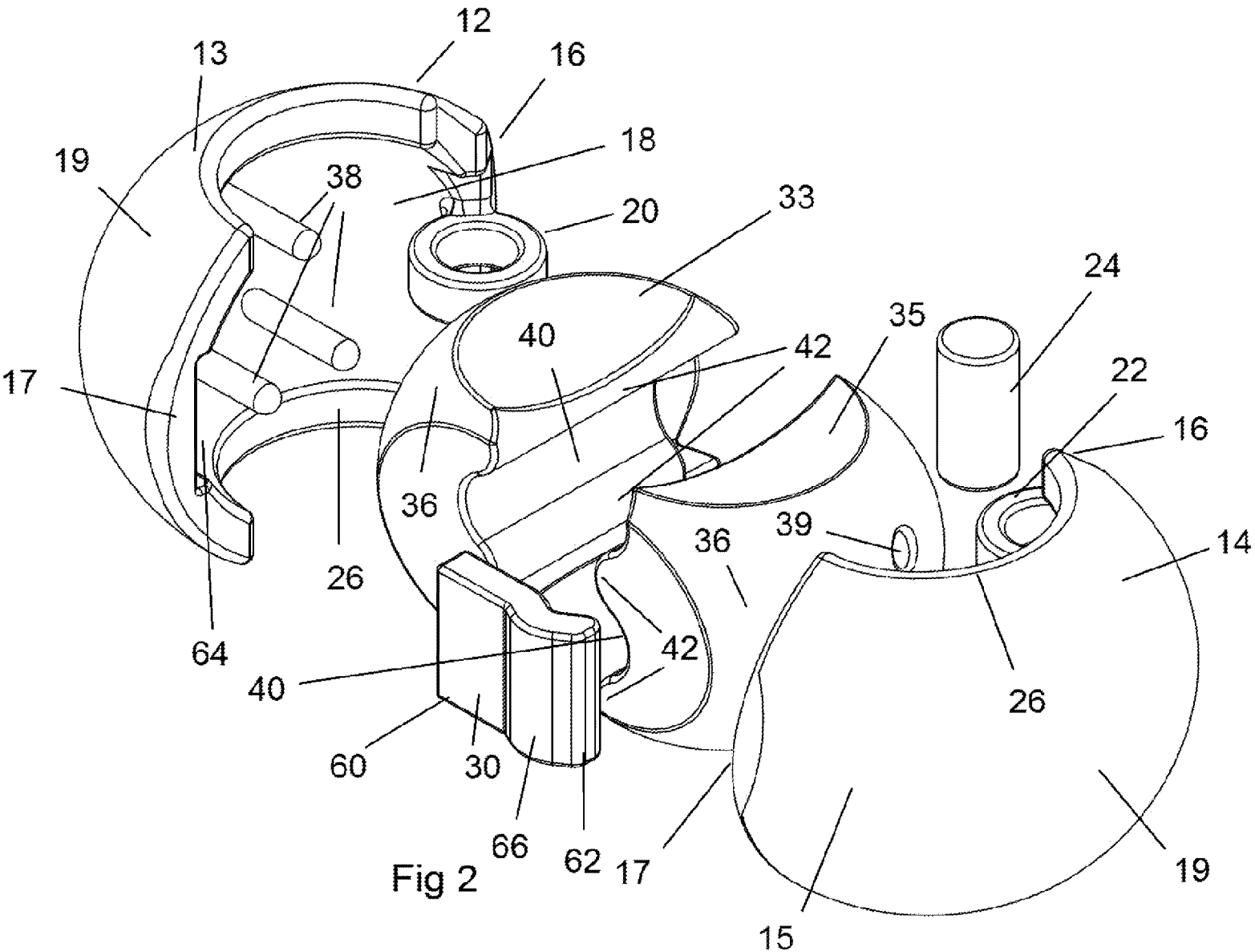
FIG. 2 is an exploded view of the bead of FIG. 1.
Figure 3A:
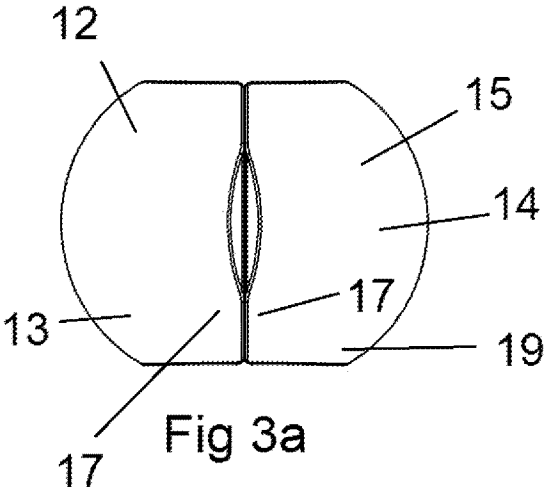
FIG. 3*a* is a first side view of the bead of FIG. 1.
Figure 3B:
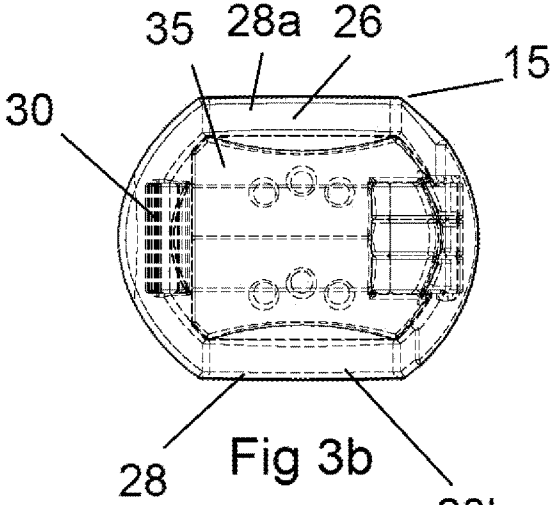
FIG. 3*b* is a front cross sectional view of the bead of FIG. 1.
Figure 3C:
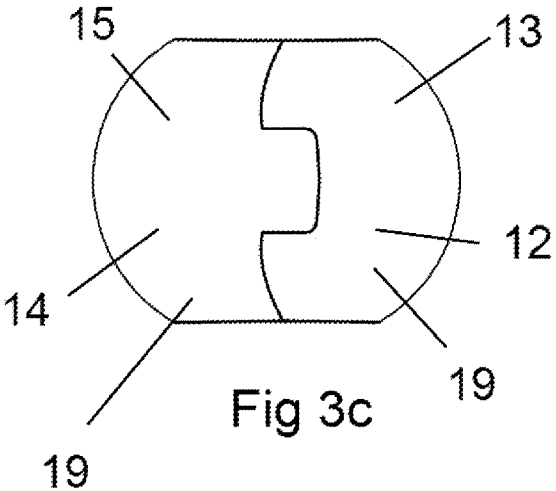
FIG. 3*c* is a second side view of the bead of FIG. 1.
Figure 3D:
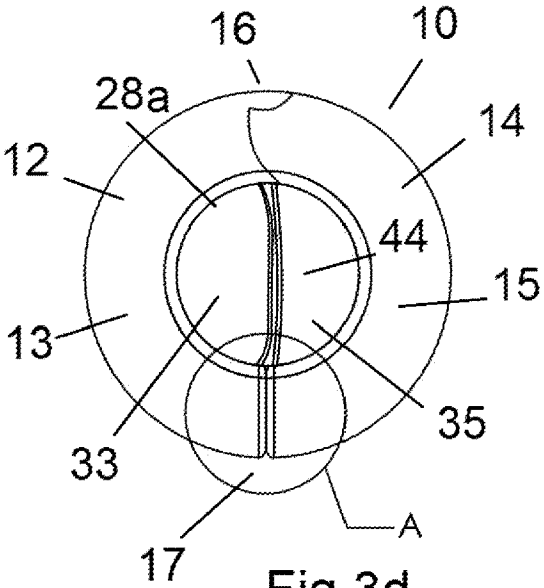
FIG. 3*d* is a top view of the bead of FIG. 1.
Figure 3E:
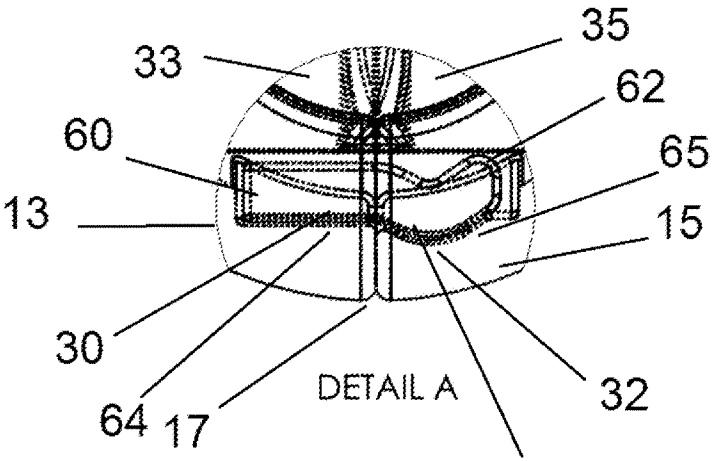
FIG. 3*e* is a close up view of Detail A of FIG. 3*d;*

Referring to the Figures, there is shown a bead 10 comprising a first member 12 and a second member 14. The first and second members 12 and 14 are pivotally connected to each other such that the first and second members 12 and 14 are moveable between a closed position (as shown in FIG. 1*a*) and an open position (as shown in FIG. 1*b*).

The first and second members 12 and 14 are moved to the open position to receive a portion of hair 11 and then moved to the closed position to engage the hair 11 and thereby secure the bead 10 relative to the hair 11. In the closed position, first surfaces 18 of each of the first and second members 12 and 14 are moved towards each other. The first surfaces 18 of the first and second members 12 and 14 move away from each other as the bead 10 moves to the open position.

In the embodiment shown, the first member 12 comprises a hemispherical first shell 13 and the second member 14 comprises a hemispherical second shell 15. The first surfaces 18 of the first and second shells 13 and 15 are therefore concave in shape and opposed second surfaces 19 are convex in shape. In the closed position, the first surfaces 18 of the first and second shells 13 and 15 define a generally spherical chamber. The second surfaces 19 in the closed position define a generally spherical outer wall of the bead 10.

The first and second members 12 and 14 are pivotally connected adjacent first sides 16 thereof. The pivotal connection between the first sides 16 is provided by a hinge mechanism. In the embodiment shown, the hinge mechanism comprises one or more first barrels 20 provided on the first member 12 adjacent the first side 16 thereof and one or more second barrels 22 provided on the second member 14 adjacent the first side 16 thereof. In the embodiment shown, there is provided a single first barrel 20 and a pair of second barrels 22 such that, in use, the first barrel 20 is received between the second barrels 22.

When the first sides 16 of the first and second members 12 and 14 are located adjacent each other, the first and second barrels 20 and 22 align to define a common aperture through which a pin 24 is received. The first and second members 12 and 14 pivot about the pin 24 to form the pivotal connection.

Each of the first and second shells 13 and 15 includes recessed portions 26 adjacent opposed upper and lower ends thereof. The recessed portions 26 are generally semicircular such that the recessed portions 26 adjacent upper ends of the first and second shells 13 and 15 define a circular first opening 28*a* when the bead 10 is in the closed position and the recessed portions 26 adjacent lower ends of the first and second shells 13 and 15 define a circular second opening 28*b* when the bead is in the closed position.

The bead 10 includes also a latch mechanism such that the latch mechanism holds the first and second members 12 and 14 in the closed position. In the embodiment shown, the latch mechanism comprises a latch member 30. The latch member 30 is secured to the first shell 13 adjacent a second side 17 thereof. The latch member 30 comprises an elongate member having a first end 60 received in a first slot 64 provided on an inner surface of the first shell 13 adjacent the second side 17.

The latch member 30 includes also a second end 62 which protrudes beyond the second side 17 of the first shell 13. The second side 17 of the second shell 15 includes a second slot 65 provided on an inner surface thereof for receiving the second end 62 of the latch member 30. The second end 62 of the latch member 30 includes a protruding portion 66 on an outer side thereof provided to resiliently engage in a corresponding notch 32 provided in the second slot 65 when the bead 10 is moved to the closed position.

The first member 12 is provided with a first resilient pad 33 and the second member 14 is provided with a second resilient pad 35. Each of the first and second resilient pads 33 and 35 is arranged to be received against the first surface 18 of the corresponding first or second shell 13 or 15. Each of the first and second resilient pads 33 and 35 therefore includes an outer surface 36 which is convex in shape to be received into the concave first surface 18 of the first or second shell 13 or 15. Each of the first and second resilient pads 33 and 35 is constructed of a suitably resilient material, such as silicone.

The first and second resilient pads 33 and 35 are secured to the first surfaces 18 of the first and second shells 13 and 15. In the embodiment shown, the first surfaces 18 are provided with pegs 38 extending outwardly therefrom. The pegs 38 are received in corresponding holes 39 in the outer surfaces 36 of the first and second resilient pads 33 and 35 to secure the first and second resilient pads 33 and 35 to the first and second shells 13 and 15.

Opposed inner surfaces 40 of each of the first and second resilient pads 33 and 35 comprise complementary mating surfaces. That is, the inner surface 40 of the first resilient pad 33 includes one or more protruding portions which are received in corresponding recessed portions in the inner surface 40 of the second resilient pad 35. In the embodiment shown, the protruding portions comprise ridges 42 extending generally from adjacent the first sides 16 of the first and second members 12 and 14 to adjacent the second sides 17. That is, the ridges 42 extend perpendicular to the direction hair would pass through the bead 10 from the first opening 28*a* to the second opening 28*b*.

In the embodiment shown, the ridges 42 are arcuate in transverse cross section such that the inner surface 40 of each of the first and second resilient pads 33 and 35 comprises corrugations extending transversely to an axis passing centrally through the first and second openings 28*a* and 28*b*.

The first and second resilient pads 33 and 35 include also upper and lower end surfaces 44. The upper end surfaces 44 of the first and second resilient pads 33 and 35 are each concave, prior to engagement of the first and second members 12 and 14. The lower end surfaces 44 of the first and second resilient pads 33 and 35 are also concave, prior to engagement of the first and second members 12 and 14. As the first and second members 12 and 14 are secured together, the first and second resilient pads 33 and 35 are pressed together and the upper and lower end surfaces 44 bulge outwardly, due to the resilient nature of the material, to become generally planar.

Figure 4B:
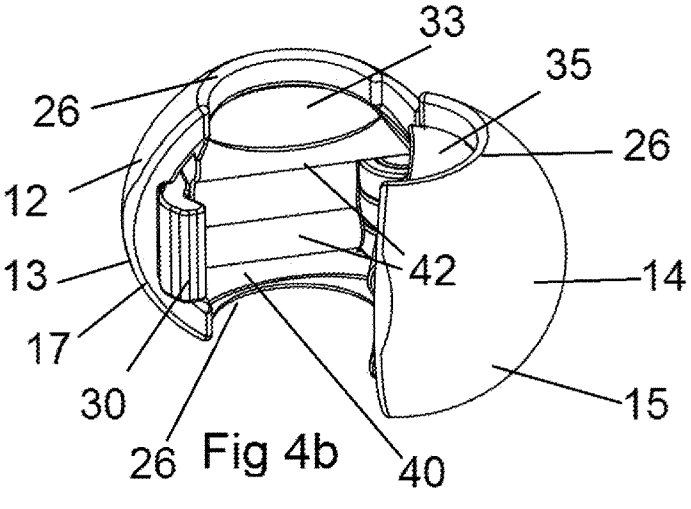
FIG. 4*b* is an upper perspective view of the bead in the open position.
Figure 4D:
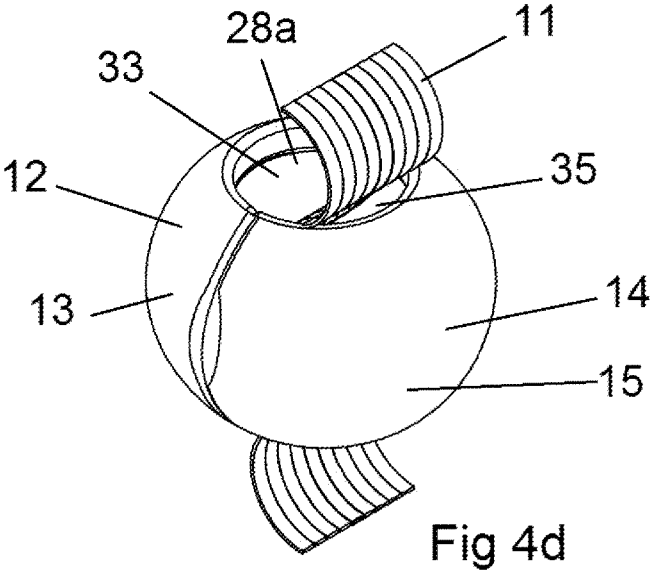
FIG. 4*d* is an upper perspective view of the bead moved to the closed position, thereby clamping the hair.
Figure 4A:
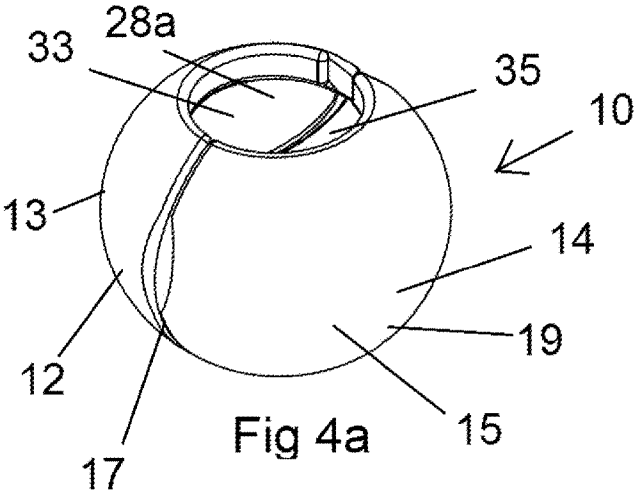
FIG. 4*a* is an upper perspective view of the bead in the closed position.
Figure 4C:
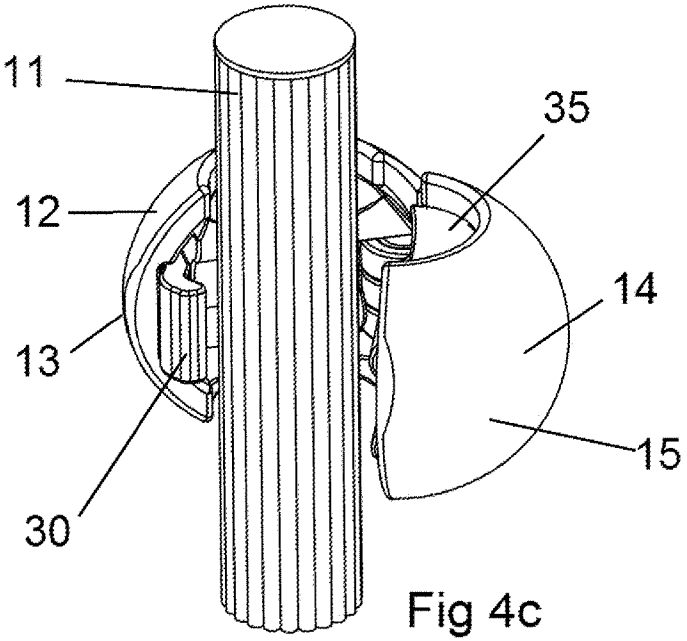
FIG. 4*c* is an upper perspective view of the bead receiving hair in the open position.

In use, the beads 10 are moved from the closed position (as shown in FIG. 4*a*) to the open position (as shown in FIG. 4*b*) to receive hair 11. A portion of hair 11 is then placed between the first and second members 12 and 14 (as shown in FIG. 4*c*) and the first and second members 12 and 14 pressed back to the closed position (as shown in FIG. 4*d*).

Figure 6B:
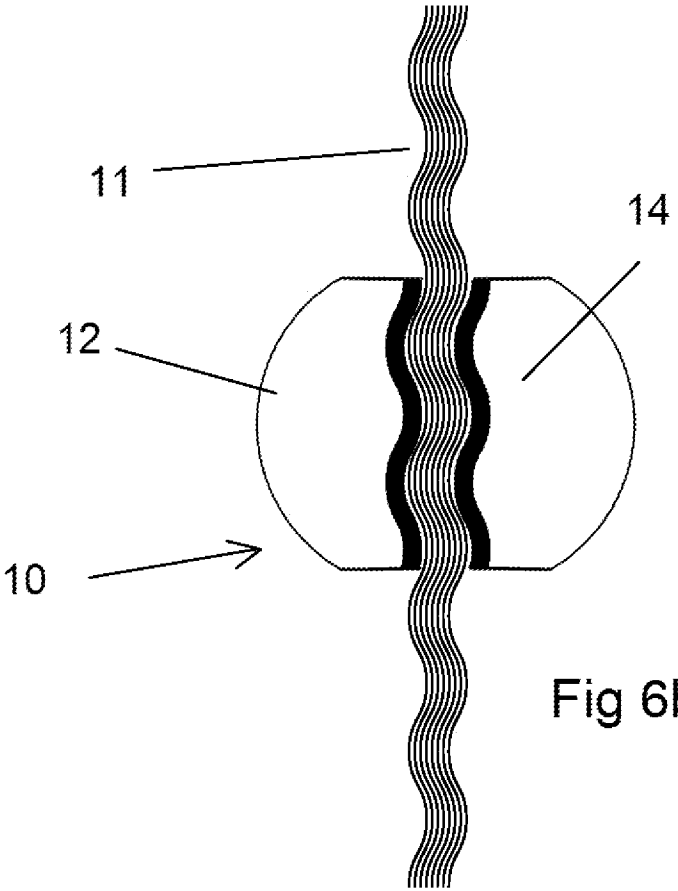
FIG. 6*b* is a side view of hair engaged between the resilient pads of the bead.

In the closed position, the resilient pads 33 and 35 are pressed together and thereby apply force to clamp the hair 11. The clamping force applied, the gripping nature of the resilient material and the fact the hair 11 changes direction as it passes over the ridges 42 as it extends through the bead 10 (as shown in FIG. 6*b*) all act to resist sliding movement of the bead 10 relative to the hair 11. The bead 10 is therefore relatively easily and securely attached to the hair 11. The outer surfaces 19 of the shells 13 and 15 may be provided with various colourings and/or ornamentation to enhance the appearance of the hair 11 to which the bead 10 is attached.

Figure 6A:
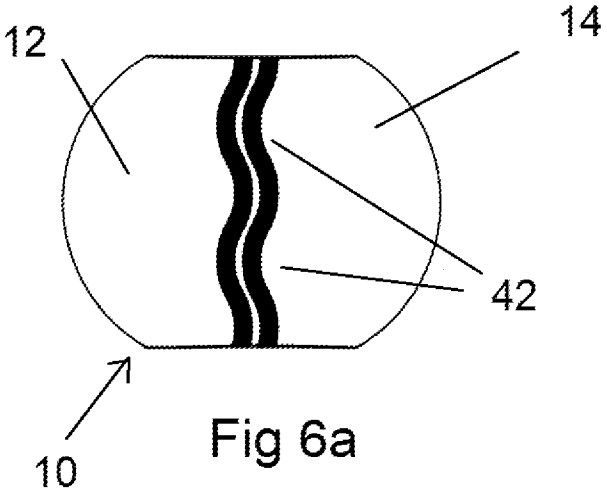
FIG. 6*a* is a side view showing the engagement between the ridges of the resilient pads.
Figure 7B:
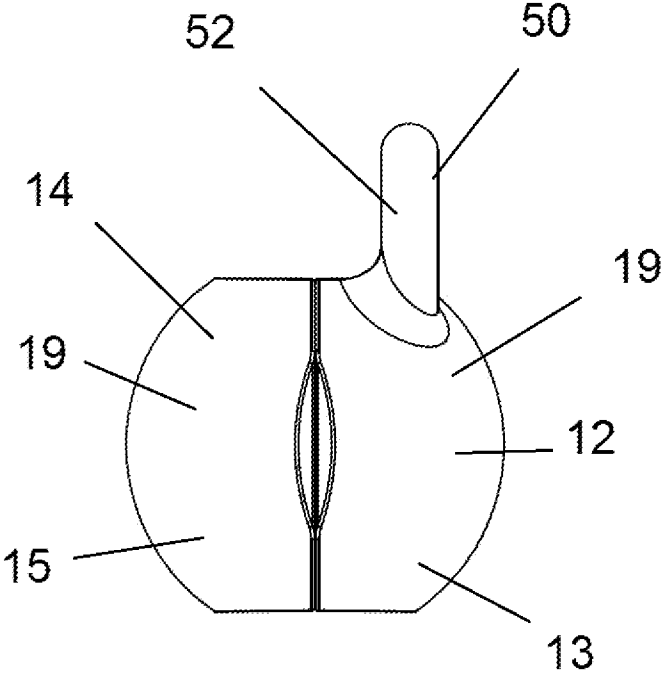
FIG. 7*b* is a side view of the bead of FIG. 7*a;*
Figure 7A:
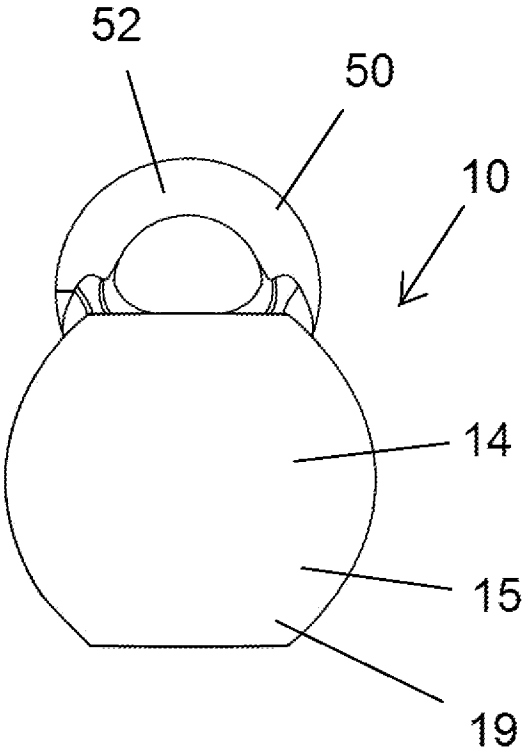
FIG. 7*a* is front view of a second embodiment of a bead in accordance with the present invention.
Figure 8B:
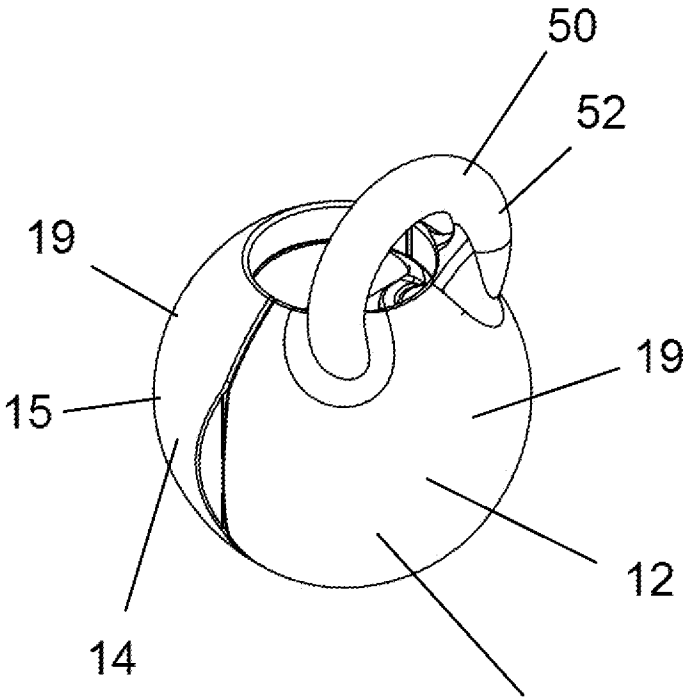
FIG. 8*b* is a second upper perspective view of the bead of FIG. 7.
Figure 8A:
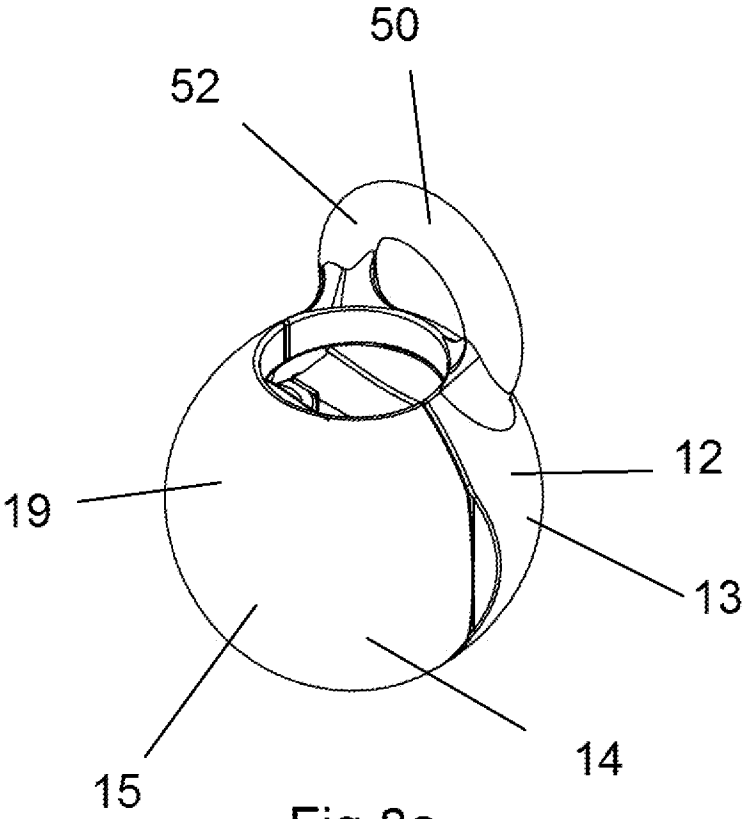
FIG. 8*a* is a first upper perspective view of the bead of FIG. 7.
Figure 9:
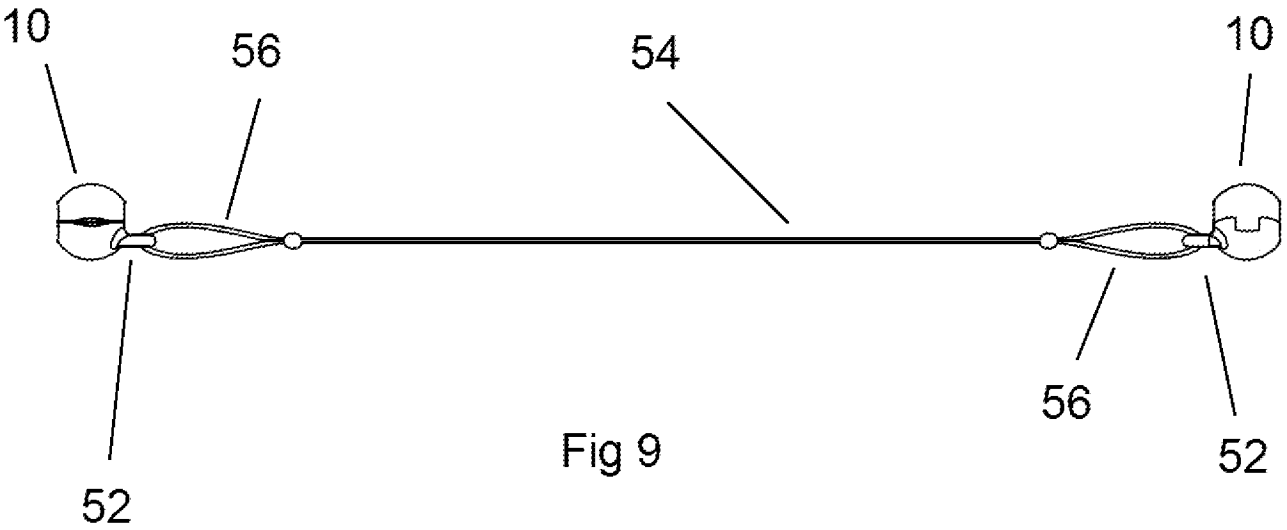
FIG. 9 is a view of a cord connecting between two of the beads of FIG. 7.

FIGS. 7 to 9 show a second embodiment of a bead 10 in accordance with the present invention. The bead 10 is similar to the embodiment of FIGS. 1 to 6 and like reference numerals are used to denote like parts.

Figure 5C:
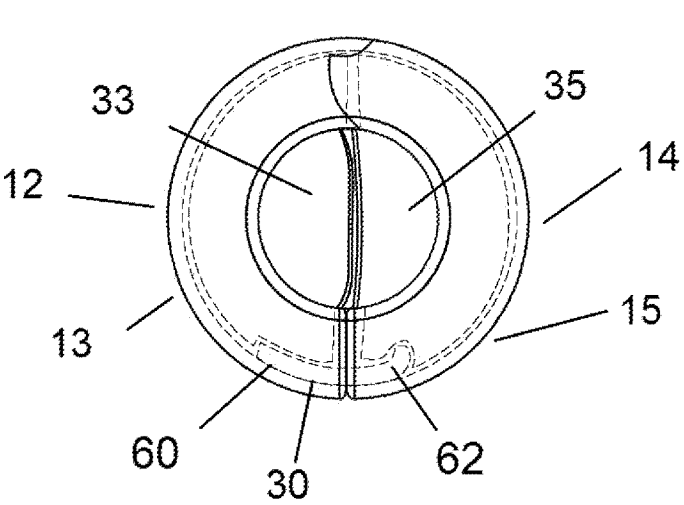
FIG. 5*c* is a top view of the bead of FIG. 1 in the closed position.
Figure 5B:
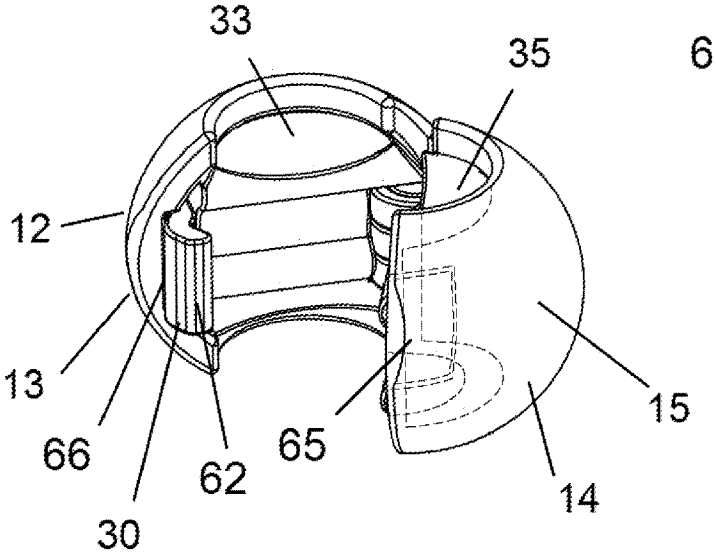
FIG. 5*b* is an upper perspective view of the bead of FIG. 1 in the open position.
Figure 5A:
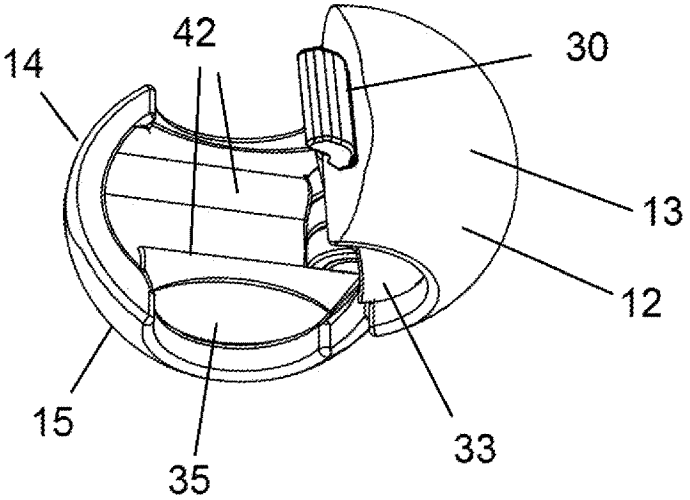
FIG. 5*a* is a lower perspective view of the bead of FIG. 1 in the open position.

The bead 10 of FIGS. 5 to 7 includes a connector 50 on an outer surface thereof. The connector 50 comprises a loop 52 extending outwardly from the second surface 19 of the first shell 13. The loop 52 is located adjacent the recessed portion 26 such that the loop 52 extends away from the second surface 19 adjacent the opening 28*a*.

The loop 52 is provided for connection to a cord 54 (as can be seen in FIG. 9). The cord 54 comprises a flexible elongate member of a suitable material having looped ends 56. The looped ends 56 may be connected through the loops 52 of a pair of beads 10 as shown.

The cord 54 may comprise a ribbon or other ornamental band which can be wound around or through the hair. Ornaments such as attachable charms may also be secured to the cord 54

It will be readily apparent to persons skilled in the relevant arts that various modifications and improvements may be made to the foregoing embodiments, in addition to those already described, without departing from the basic inventive concepts of the present invention.

The invention claimed is:

1. A bead comprising:

first member and second member pivotally secured adjacent first sides thereof such that the first and second members are pivotable between a closed position, in which a second side of the first member is located adjacent a second side of the second member, and an open position in which the second sides of the first and second members have moved away from each other;

a first and second openings defined between the first and second side members when in the closed position;

a first resilient pad provided on a first surface of the first member; and a second resilient pad provided on an adjacent first surface of the second member;

wherein the first and second resilient pads include complementary ridges on adjacent inner surfaces extending continuously along a length from adjacent the first side of the first and second members to adjacent the second side of the first and second members such that when the first and second members are in the closed position, the ridges engage to deflect the hair passing through the bead from the first opening to the second opening, the ridges, being arcuate in transverse cross section, form continuous corrugations extending transversely to an axis passing centrally through the first and second openings;

wherein the ridges extend perpendicular to a direction of the hair passing through the bead from the first opening to the second opening, such that the hair changes direction as it passes over the ridges;

wherein the first member comprises a hemispherical first shell and the second member comprises a hemispherical second shell such that the first surfaces of the first and second shells are concave in shape and opposed second surfaces are convex in shape;

wherein each of the first and second resilient pads includes an outer surface which is convex in shape to be received into the concave first surface of the first or second shell; and wherein end surfaces of the first and second resilient pads are each concave prior to engagement together such that as the first and second resilient pads are pressed together, the upper and lower end surfaces bulge outwardly, due to the resilient nature of the material, to become generally planar.

2. The bead in accordance with claim 1, wherein the first and second resilient pads are secured to the first surfaces of the first and second shells by pegs extending outwardly from the first surfaces to be received in corresponding holes in the outer surfaces of the first and second resilient pads.

3. The bead in accordance with claim 2, wherein the first and second resilient pads are constructed of a silicone material.

4. The bead in accordance with 1, wherein each of the first and second shells includes recessed portions adjacent opposed ends thereof such that the recessed portions define circular first and second openings when the bead is in the closed position.

5. The bead in accordance with claim 4, wherein the bead includes a latch mechanism such that the latch mechanism holds the first and second members in the closed position.

6. The bead in accordance with claim 5, wherein the latch member comprises an elongate member having a first end received in a first slot provided on an inner surface of the first shell adjacent the second side and a protruding second end receivable in a second slot provided on an inner surface of the second shell.

7. The bead in accordance with claim 6, wherein the second end of the latch member includes a protruding portion on an outer side thereof provided to resiliently engage in a corresponding notch provided in the second slot when the bead is moved to the closed position.

8. The bead in accordance with claim 7, wherein the pivotal connection between the first sides is provided by a hinge mechanism comprising one or more first barrels provided on the first member adjacent the first side thereof and one or more second barrels provided on the second member adjacent the first side 16 thereof, the first and second barrels including alignable apertures to receive a pin.

9. The bead in accordance with claim 8, wherein the bead includes a connector on an outer surface thereof to which the end of a cord may be secured such that the cord can extend between a pair of beads.

10. The bead in accordance with claim 9, wherein the connector comprises a loop extending outwardly from the second surface of the first shell.

11. The bead in accordance with claim 1, wherein the first and second resilient pads are constructed of a silicone material.

12. The bead in accordance with claim 1, wherein the bead includes a latch mechanism such that the latch mechanism holds the first and second members in the closed position.

13. The bead in accordance with claim 1, wherein the pivotal connection between the first sides is provided by a hinge mechanism comprising one or more first barrels provided on the first member adjacent the first side thereof and one or more second barrels provided on the second member adjacent the first side 16 thereof, the first and second barrels including alignable apertures to receive a pin.

14. The bead in accordance with claim 1, wherein the bead includes a connector on an outer surface thereof to which the end of a cord may be secured such that the cord can extend between a pair of beads.

15. A bead comprising:

first member and second members pivotally secured adjacent first sides thereof such that the first and second members are pivotable between a closed position, in which a second side of the first member is located adjacent a second side of the second member, and an open position in which the second sides of the first and second members have moved away from each other;

a first and second openings defined between the first and second side members when in the closed position;

a first resilient pad provided on a first surface of the first member; and a second resilient pad provided on an adjacent first surface of the second member;

wherein the first and second resilient pads include complementary ridges on adjacent inner surfaces extending continuously along a length from adjacent the first side of the first and second members to adjacent the second side of the first and second members such that when the first and second members are in the closed position, the ridges engage to deflect the hair passing through the bead from the first opening to the second opening, the ridges, being arcuate in transverse cross section, form continuous corrugations extending transversely to an axis passing centrally through the first and second openings;

wherein the ridges extend perpendicular to a direction of the hair passing through the bead from the first opening to the second opening, such that the hair changes direction as it passes over the ridges;

wherein end surfaces of the first and second resilient pads are each formed to be concave prior to engagement together and formed such that as the first and second resilient pads are pressed together, the upper and lower end surfaces bulge outwardly to become generally planar due to the resilient material; and wherein each of the first and second shells includes recessed portions adjacent opposed ends thereof such that the recessed portions define circular first and second openings when the bead is in the closed position.

* * * * *